US007012361B2

(12) United States Patent
Kanesaka

(10) Patent No.: US 7,012,361 B2
(45) Date of Patent: Mar. 14, 2006

(54) VACUUM FLUORESCENT DISPLAY DEVICE AND THE SUPPORT OF THE CATHODE THEREOF

(75) Inventor: Satoshi Kanesaka, Chiba (JP)

(73) Assignee: Futaba Corporation, Chiba (JP)

( * ) Notice: Subject to any disclaimer, the term of this patent is extended or adjusted under 35 U.S.C. 154(b) by 176 days.

(21) Appl. No.: 10/657,228

(22) Filed: Sep. 9, 2003

(65) Prior Publication Data

US 2004/0051442 A1 Mar. 18, 2004

(30) Foreign Application Priority Data

Sep. 12, 2002 (JP) ..... 2002-267137

(51) Int. Cl.
*H01J 1/88* (2006.01)

(52) U.S. Cl. ..... 313/493; 313/272; 313/278; 313/513

(58) Field of Classification Search ..... 313/272, 313/276, 278, 292, 310, 495, 493, 496
See application file for complete search history.

(56) References Cited

U.S. PATENT DOCUMENTS 5,204,583 A * 4/1993 Jeong ..... 313/496
5,424,607 A * 6/1995 Jeong ..... 313/496
5,625,254 A * 4/1997 Hamada ..... 313/493

* cited by examiner

*Primary Examiner*—Mariceli Santiago
*Assistant Examiner*—Matt Hodges
(74) *Attorney, Agent, or Firm*—Bacon & Thomas, PLLC

(57) ABSTRACT

A fluorescent display device includes an envelop of which an inner space is in a vacuum state. The envelop has therein a plurality of filament-shaped cathodes supported by a pair of cathode supports; and anodes, each having a fluorescent material, fluorescent materials of the anodes radiating light by impaction of electrons emitted from the cathodes. Each of the cathode supports includes a base fixed to the envelop; one or more anchors, each having an arm serving as a resilient member and a tab for supporting one end of a cathode, the arm having two opposite end portions, one end portion being connected to the base and the tab being disposed at the other end portion; and one or more support members, each being connected to the base and separated from an arm of its adjacent anchor and supporting one end of another cathode.

9 Claims, 6 Drawing Sheets

VACUUM FLUORESCENT DISPLAY DEVICE AND THE SUPPORT OF THE CATHODE THEREOF

FIELD OF THE INVENTION

The present invention relates to a vacuum fluorescent display device; and, more particularly, to an improved support of cathode (hereinafter, referred to as "cathode support") composed of an anchor and a support for supporting filament-shaped cathodes.

BACKGROUND OF THE INVENTION

FIG. 5 shows a cross-sectional view of an exemplary conventional vacuum fluorescent display device taken along the line V—V shown in FIG. 6. FIG. 6 illustrates a cross-sectional view taken along the line VI—VI depicted in FIG. 5. In FIG. 5, control electrodes 9 and anodes 8 illustrated in FIG. 6 are omitted for simplicity. The vacuum fluorescent display device illustrated in FIGS. 5 and 6 includes a sealed box-shaped envelop 1 made of an insulating material, e.g., glass. The inner space of the envelop 1 is maintained in a high vacuum state. The envelop 1 is provided with an insulating anode substrate 2 and a front substrate 3, which face each other at a certain distance therebetween. A frame-shaped side plate 4 is installed along peripheries of the anode and the front substrate 2 and 3. The side plate 4, the anode substrate 2 and the front substrate 3 are air-tightly coupled together by using a sealant 5. Formed on an inner surface of the anode substrate 2 in a certain pattern are anodes 8 each being composed of an anode conductor 6 and a fluorescent substance layer 7 disposed thereon. Further, control electrodes 9 are installed above the anodes 8 and filament-shaped cathodes 10 are extended above the control electrodes 9.

Each filament-shaped cathode 10 has a structure in which a thermionic emission layer composed of a composite oxide of, e.g., alkaline earth metals (Ca, Sr, Ba, and the like) is disposed around a core wire made of tungsten or tungsten-based alloy.

With the application of certain filament voltage to the filament-shaped cathode 10, the thermionic emission layer is heated to a temperature of about 600–650° C. Electrons emitted from the thermionic emission layer of the cathode 10 are controlled by the control electrodes 9 and collide against the anodes 8 to allow the fluorescent substance layer 7 to radiate light. The emitted light is seen at the outside of the envelop 1 through the light transmitting front substrate 3.

In order to prevent the filament-shaped cathode 10 from being loose due to thermal expansion caused by electric heating, the filament-shaped cathode 10 needs to be supported by cathode supports employing a spring-like member having adequate tension force and stroke. To this end, the cathode supports include an anchor and a support.

In the conventional vacuum fluorescent display device as shown in FIGS. 5 and 6, the cathodes 10 in the envelop 1 are supported under tension by a pair of cathode supports 11 and 12. The cathode supports 11 and 12 are made by press-working metal sheets, one of which being an anchor 11 for holding one ends of filament-shaped cathodes 10 and the other being a support member 12 for supporting the other ends thereof. The anchor 11 is provided with a base 11*a* fixed on the anode substrate 2; spring-shaped arms 11*b* seamlessly formed with the base 11*a*; and tabs 11*c*, provided at distal ends of the arms 11*b*, for supporting one ends of the cathodes 10, respectively. The support 12 is provided with a base 12*a* fixed on the anode substrate 2; and a tab 12*b*, seamlessly formed with the base 12*a*, for supporting the other ends of the cathodes 10.

In the vacuum fluorescent display device shown in FIG. 5, a plurality of (four in FIG. 5) cathodes 10 are arranged in parallel and supported by the anchor 11 and the support 12. The cathodes 10 are regularly spaced apart from each other in a direction perpendicular to a lengthwise direction of the anchor 11 and the support 12. Accordingly, the arms 11*b* of the anchor 11 need to be arranged in an approximately same direction, which is slanted with respect to the lengthwise direction of the cathodes 10, and bent so that they can function as resilient members, e.g., springs, to apply tension to the cathodes 10. As a result, as viewed from the top, one of two sidemost arms 11*b* among those arranged in parallel is outwardly protruded from an area where the cathodes 10 are extended. Consequently, there occurs a dead space D on the anode substrate 2 in the envelop 1, which can not be used as a display area A due to the absence of cathode 10 provided thereabove. Accordingly, the use of the conventional cathode supports 11 and 12 inevitably limits the size of the display area A to become considerably smaller than that of the envelop 1. Moreover, it is difficult to enlarge the display area A.

In order to solve such a problem, the inventor of the present invention has developed a cathode support 13 shown in FIGS. 7 and 8. FIG. 7 is a plan view of the cathode support 13 made of a metal sheet and installed on the anode substrate 2, for holding four cathodes 10, and FIG. 8 is a development view thereof. The cathode support 13 includes a base 13*a* fixed on the anode substrate 2; two anchors 14 spaced apart by a predetermined distance therebetween, each anchor 14 having an arm 14*a* which is provided with a distal end at which a tab 14*b* for attaching one end of a cathode 10 thereon is disposed and a proximal end portion of which one side is seamlessly connected to the base 13*a*; a first support 15*a* seamlessly provided at the other side of the proximal end portion of an arm 14*a* of the inner anchor 14; and a second support 15*b* spaced apart from the first support 15*a* by a certain distance and seamlessly formed with the base 13*a*. The above-described cathode support 13 shown in FIG. 7 is used for supporting one ends of the cathodes 10, while the other ends thereof are supported by another cathode support disposed on the anode substrate 2 in a rotationally symmetrical relationship with the cathode support 13.

Using the cathode support 13 illustrated in FIG. 7 can lead to a vacuum fluorescent display device having the same number of cathodes and an equal-sized display area as in the vacuum fluorescent display device illustrated in FIG. 5. In such a case, however, no dead space is generated by the arms 14*a* of the cathode support 13, and therefore, a size of an envelop can be made smaller than that of the envelop shown in FIG. 5. On the other hand, in case of maintaining the size of an envelop while employing a cathode support of the type shown in FIG. 7, more cathodes 10 can be arranged than in the vacuum fluorescent display device shown in FIG. 5, thereby allowing the display area to be enlarged.

However, with the configuration of the cathode support 13 illustrated in FIG. 7, it is difficult to save power and/or increase brightness by reducing the distance between the cathodes 10 and the anodes 8 and then applying a low voltage to the cathodes 10.

Specifically, electrons emitted from the cathodes 10 are diffused as shown in FIG. 9 and then collide against the anodes 8 of the anode substrate 2. Thus, if the distance FH between the cathodes 10 and the anodes 8 is reduced while maintaining the distance FW between the cathodes 10, there occur on the anode substrate 2 some areas which electrons cannot reach. With reference to FIG. 9, if the distance between the cathodes 10 and the anodes 8 is reduced from FH1 to FH2, i.e., the position of the anodes 8 is lifted up to the line L shown in FIG. 9, the electrons do not reach area B on the anode substrate 2.

In this case, when the distance FW between the cathodes 10 is reduced, there occurs no area B where the electrons do not reach even though the distance FH between the cathodes 10 and the anodes 8 is reduced. Accordingly, it is possible to save power and/or improve brightness by applying a low voltage to the control electrodes 9 and the anodes 8.

However, with the structure of the cathode support 13 illustrated in FIG. 7, it is difficult to reduce the distance FW between the cathodes 10. In order to reduce the distance FW, the length of the arms 14*a* and the distance therebetween should be shortened and the location of the first support 15*a* directly provided as shown in FIG. 8 at the proximal end portion of an arm 14*b* also needs to be changed. In that case, since the arms 14*a* can not effectively function as springs, sufficient tension force can not be applied to the cathodes 10. Therefore, it is difficult to reduce the distance FW between the cathodes 10 down to a certain value, e.g., less than or equal to 3 mm, while maintaining the resilience of the arm 14*a*. Accordingly, with the use of the cathode support 13 of FIG. 7 having the support 15*a* directly connected with the bottom portion of an arm 14*a*, the distance FH between the cathodes 10 and the anodes 8 can not be reduced and a low voltage can not be applied to the cathode 10 for power saving and/or brightness improvement.

In addition, since the support 15*a* is provided at the bottom portion of the arm 14*a* of the inner anchor 14, vibrations from the inner anchor 14 are directly transmitted to the support 15*a*, resulting in vibration or disconnection of the cathode 10 fixed to the support 15*a*.

SUMMARY OF THE INVENTION

It is, therefore, an object of the present invention to provide a cathode support, which has an integrated anchor and support structure, and a vacuum fluorescent display device including the cathode support, the cathode support being capable of enlarging a display area compared with a case of using separated anchor and support; reducing the distance between cathodes and anodes by way of narrowing the pitch of the former and applying a low voltage to the control electrodes and the anodes in order to save power and/or enhance brightness; and preventing disconnection of a cathode due to directly transmitted vibrations from an anchor to a support for supporting the cathode.

In accordance with an aspect of the present invention, there is provided a fluorescent display device including: an envelop of which an inner space is in a vacuum state, the envelop having therein a plurality of filament-shaped cathodes supported by a pair of cathode supports; and anodes, each having a fluorescent material, fluorescent materials of the anodes radiating light by impaction of electrons emitted from the cathodes; wherein each of the cathode supports includes a base fixed to the envelop; one or more anchors, each having an arm serving as a resilient member and a tab for supporting one end of a cathode, the arm having a distal end portion and a proximal end portion, the proximal end portion being connected to the base and the tab being disposed at the distal end portion; and one or more support members, each being connected to the base and separated from the arm of its adjacent anchor and supporting one end of another cathode.

In accordance with still another aspect of the present invention, there is provided a cathode support for use in a fluorescent display device including an envelop of which an inner space is in a vacuum state, the envelop having therein filament-shaped cathodes; and anodes, each anode having a fluorescent material, fluorescent materials of the anodes radiating light by impaction of electrons emitted from the cathodes, the cathode support supporting the cathodes inside the envelop and including: a base fixed to the envelop; one or more anchors, each having an arm serving as a resilient member and a tab for supporting one end of a cathode, the arm having a distal end portion and a proximal end portion, the proximal end portion being connected to the base and the tab being disposed at the distal end portion; and one or more support members, each being connected to the base and separated from the arm of its adjacent anchor and supporting one end of another cathode.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Figure 1A:
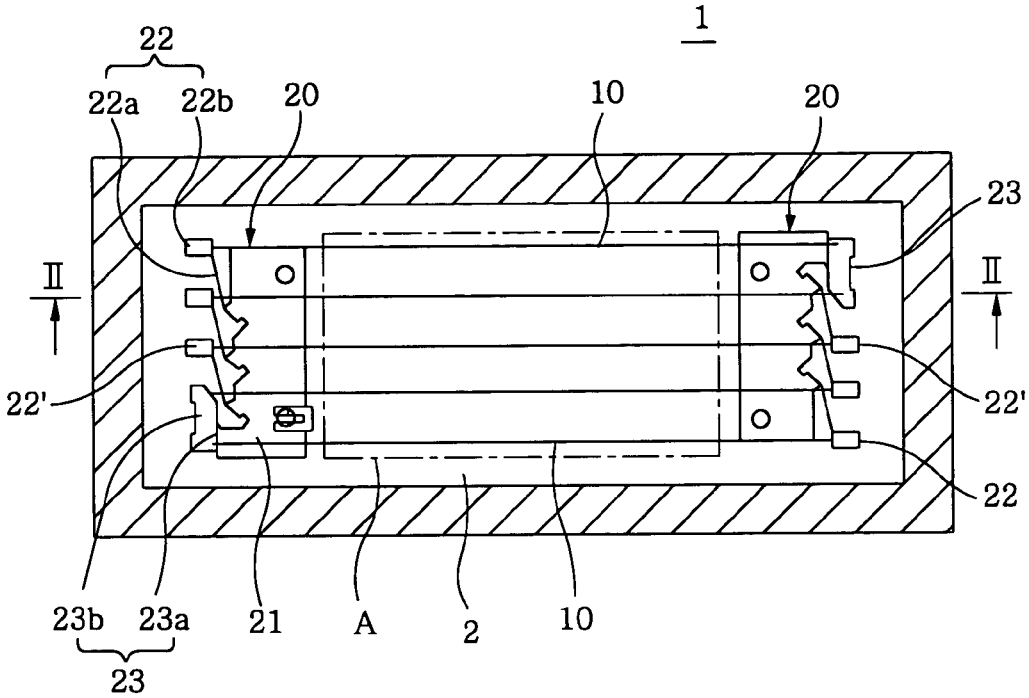
FIG. 1A shows a cross-sectional top view of a vacuum fluorescent display device in accordance with a first preferred embodiment of the present invention, which is taken along the line I—I of FIG. 2.
Figure 1B:
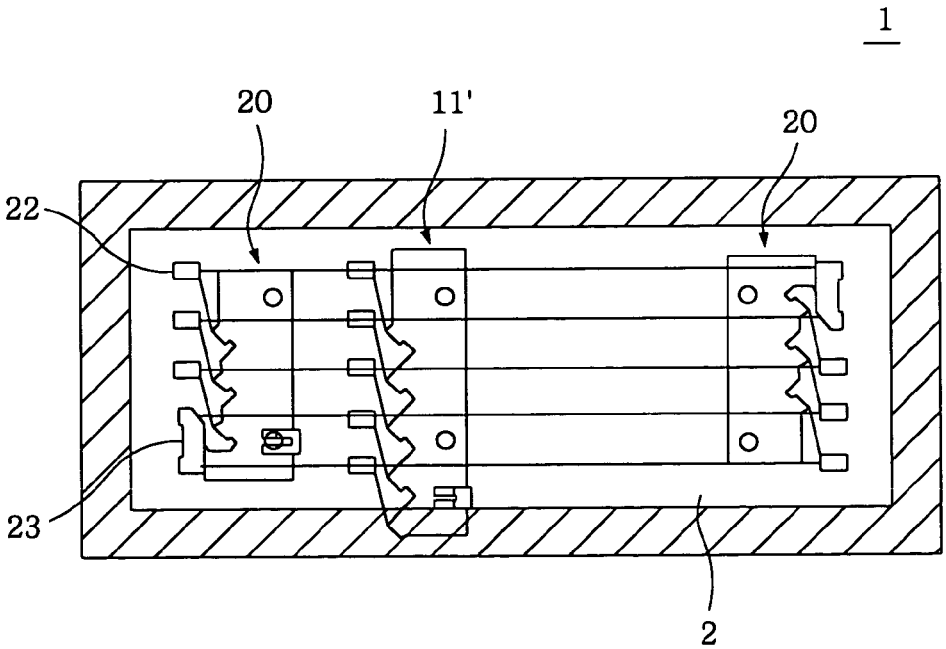
FIG. 1B describes a cross-sectional plan view of the vacuum fluorescent display device in FIG. 1A, wherein a conventional cathode support is illustrated for comparison.
Figure 2:
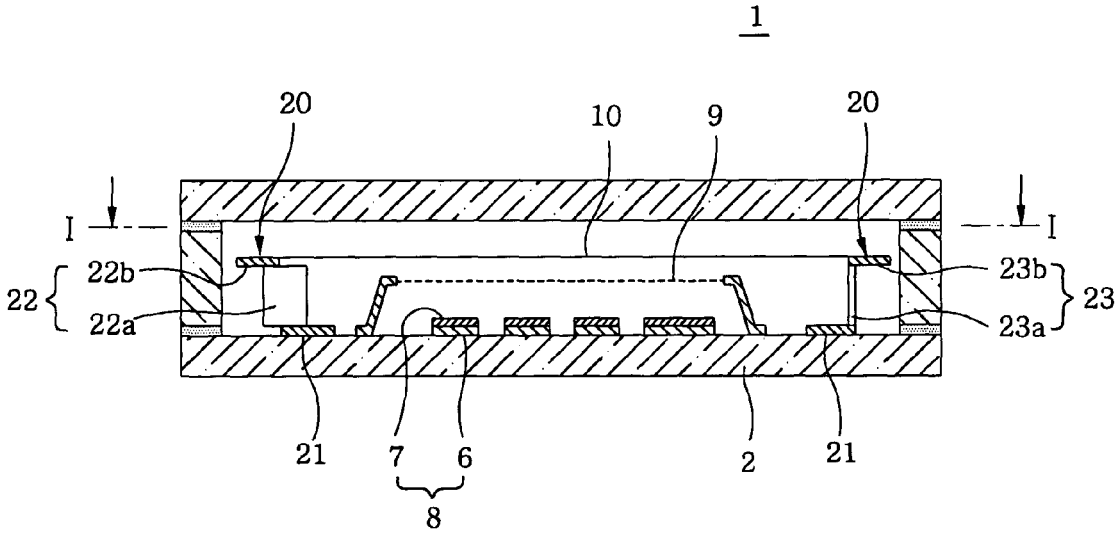
FIG. 2 depicts a cross-sectional side view of the vacuum fluorescent display device in accordance with the first preferred embodiment of the present invention, which is taken along the line II—II of FIG. 1A.
Figure 3:
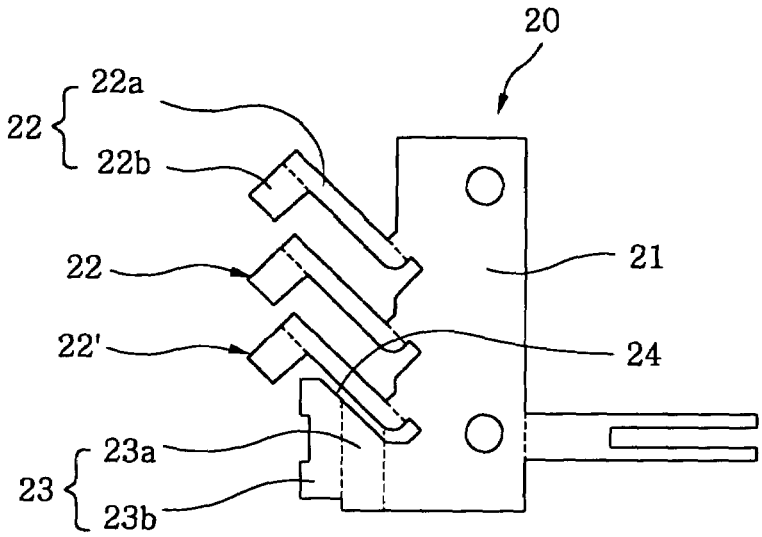
FIG. 3 is a development view of a cathode support used in the vacuum fluorescent display device in accordance with the first preferred embodiment of the present invention.

FIGS. 1A and 1B show cross-sectional top views of a vacuum fluorescent display device employing cathode supports 20 in accordance with a first preferred embodiment of the present invention. FIG. 2 illustrates a cross-sectional view taken along the line II—II in FIG. 1A. In FIGS. 1A and 1B, control electrodes 9 and anodes 8 shown in FIG. 2 are omitted for simplicity. FIG. 3 depicts a development view of a cathode support of the first embodiment. Herein, the vacuum fluorescent display device of the present invention is identical to a conventional vacuum fluorescent display device except for the configuration of the cathode supports.

Each of the cathode supports 20 in accordance with the first preferred embodiment of the present invention can be manufactured by cutting and bending a metal sheet having a thickness of about 0.05~0.06 mm by using a press machine. A plurality of anchors 22 and 22' are seamlessly formed with a base 21, which is fixed on an anode substrate 2, as similar to the prior art structure. In other words, the plurality of (3 in this example) anchors 22 and 22' regularly spaced apart from each other are seamlessly provided at one side of the base 21. Each of the anchors 22 and 22' is provided with a leaf spring-shaped arm 22*a* and a tab 22*b* provided at a distal end of the arm 22*a* for supporting one end of a cathode 10, a proximal end thereof being seamlessly connected to the base 21.

Referring to FIG. 3, a plurality of (3 in this example) arms 22*a* spaced apart from each other at regular intervals are provided in parallel at one side of the base 21. Further, a support member 23 is provided adjacent to an innermost anchor 22'. The support member 23 includes a trapezoidal base portion 23*a* to be bent upright and a tab portion 23*b* extended from the base portion 23*a*. Two cathodes 10 are connected to the tab portion 23*b* in this preferred embodiment of the present invention.

Before bending the cathode supports 20, i.e., when cutting the metal sheet into a certain shape, a slit 24 is formed between the innermost anchor 22' and the support member 23, thereby separating the anchor 22' and the support member 23. The support member 23 is also seamlessly formed with the base 21, and the support member 23 and the anchor 22' are connected with each other through the base 21. However, the support member 23 and the anchor 22' are discrete members because they are separated by the slit 24. Since the base 21 is fixed on the anode substrate 2, vibrations generated in the anchor 22' are prevented from being directly transmitted to the support member 23 to cause the disconnection of the cathodes 10 supported by the support member 23. As the slit 24 becomes wider, the support member 23 becomes narrower, thereby increasing the distance (or pitch) between the support member 23 and the anchor 22'. In this case, distances between neighboring anchors 22 and 22' are also set to be equal thereto.

The width of the slit 24 can be set with a precision of about 0.1 mm by a blanking process of a press. Thus, it is possible to set a pitch between the filament-shaped cathodes 10 to be less than or equal to 3.0 mm, e.g., 2.0 mm, by way of adopting the cathode support design described above. Accordingly, the distance FH between the cathodes 10 and anodes 8 can be made to be less than that of the prior art, thereby making it possible to save power by applying a low voltage to the control electrodes 9 and the anodes 8 and/or increase the brightness.

As can be seen from FIG. 1A, the vacuum fluorescent display device of the present invention employs two cathode supports 20 disposed in a rotationally symmetrical relationship with each other at two opposite sides of the anode substrate 2, and five cathodes 10 are extended and supported by the cathode supports 20. In this case, while the central cathode is supported by two anchors 22', the remaining cathodes are supported by the combination of the anchors 22 and the support members 23. In this way, the odd number of cathodes 10 can be supported by a pair of cathode supports 20 of an identical structure by supporting one of the cathodes 10 with two anchors 22'.

As indicated by a dotted line in FIG. 1A, a display area A can be provided close to an inner surface of an envelop 1 of the vacuum fluorescent display device in accordance with the first preferred embodiment of the present invention. As can be seen from FIGS. 1A and 5, in the vacuum fluorescent display device in accordance with the present invention, the number of cathodes 10 is increased from 4 to 5 compared with the conventional vacuum fluorescent display device having the same-sized envelop 1, so that the display area A is enlarged.

Figure 5:
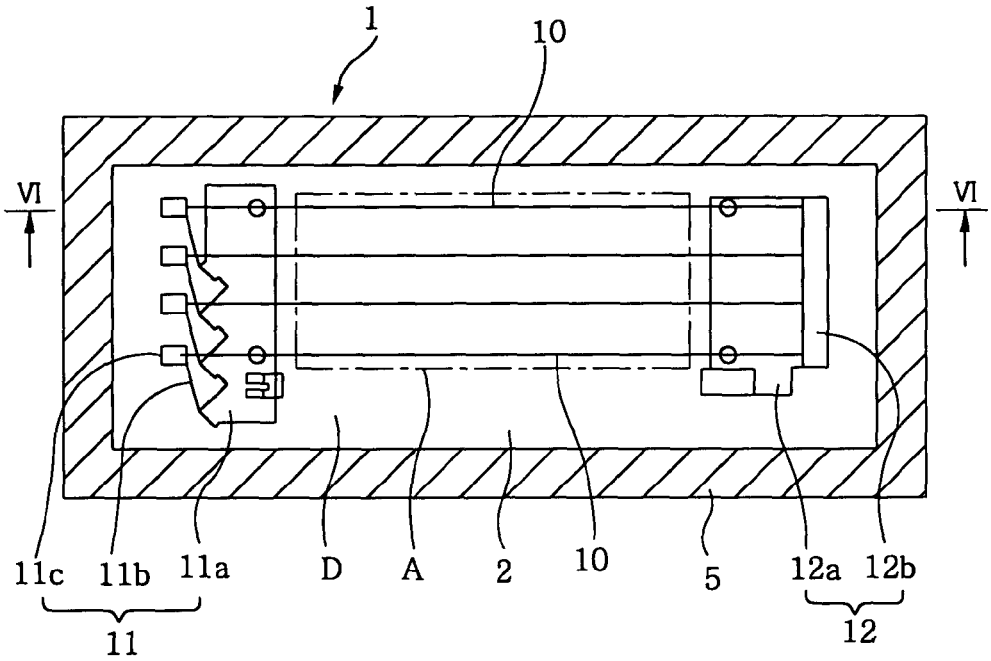
FIG.5 (PRIOR ART)
FIG. 5 offers a cross-sectional plan view of an exemplary conventional vacuum fluorescent display device, which is taken along the line V—V of FIG. 6.
Figure 6:
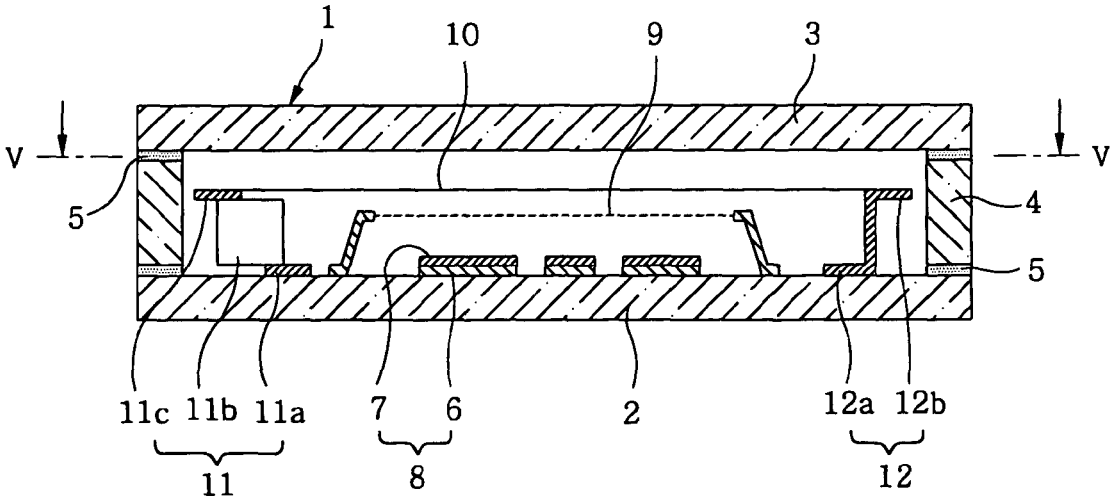
FIG.6 (PRIOR ART)
FIG. 6 illustrates a cross-sectional side view of the exemplary conventional vacuum fluorescent display device, which is taken along the line VI—VI of FIG. 5.
Figure 7:
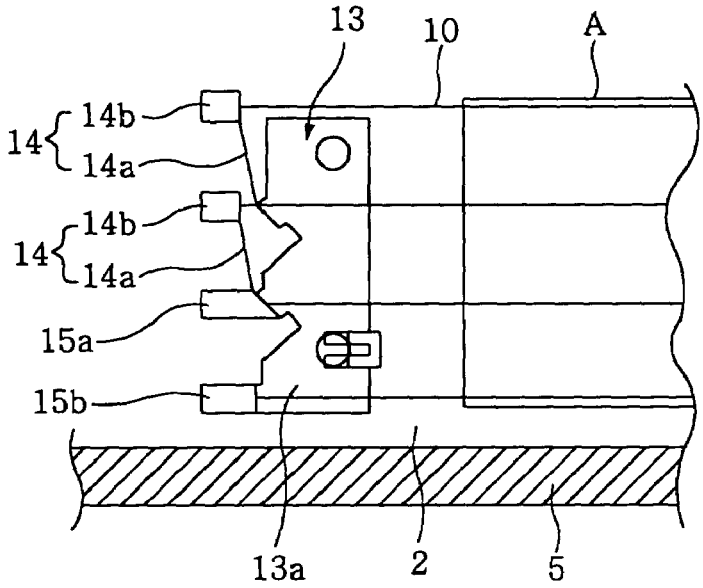
FIG. 7 (PRIOR ART)
FIG. 7 represents a top view of another exemplary conventional vacuum fluorescent display device.
Figure 8:
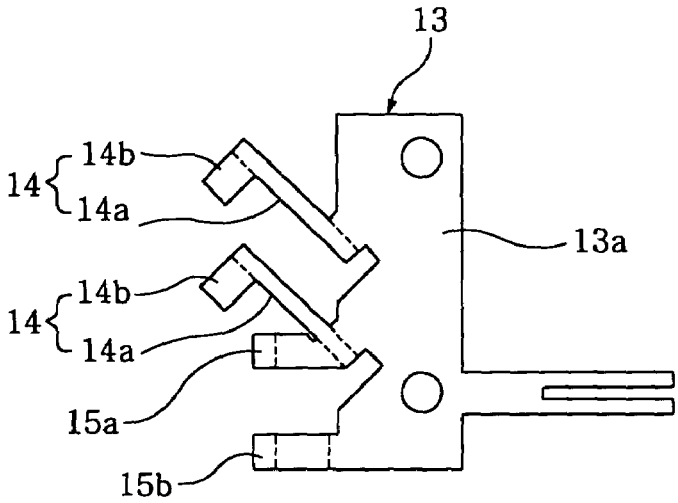
FIG. 8 (PRIOR ART)
FIG. 8 sets forth a development view of a cathode support used in the another exemplary conventional vacuum fluorescent display device shown in FIG. 8.
Figure 9:
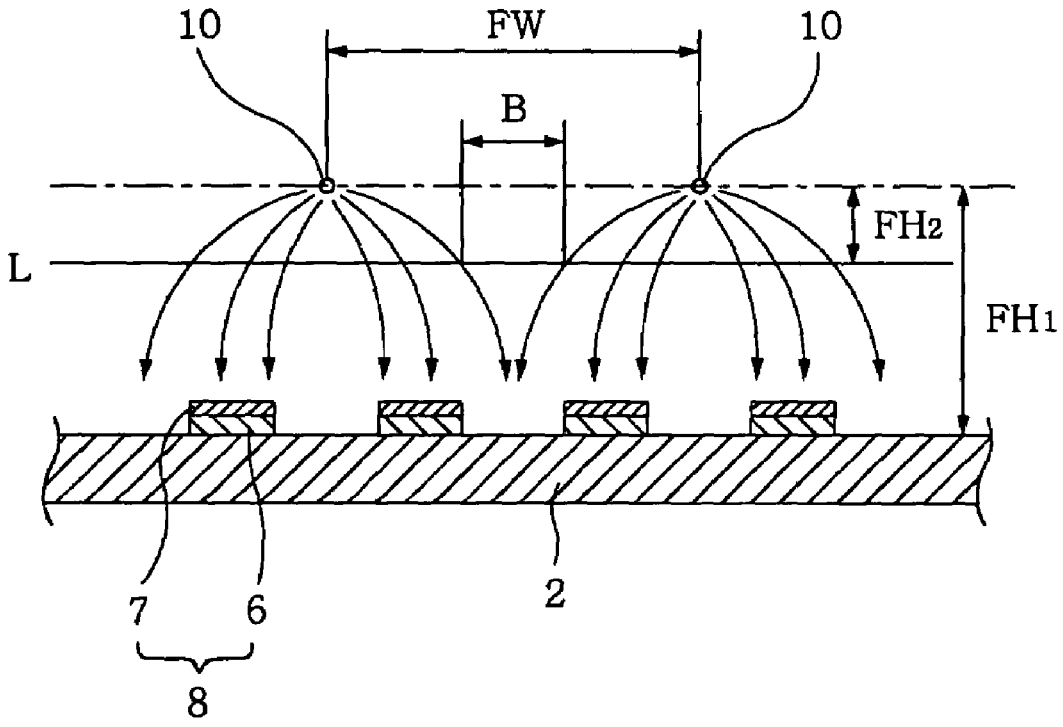
FIG. 9 schematically provides an arrangement of cathodes and anodes and a path of emitted electrons in a vacuum fluorescent display device.

FIG. 1B shows the vacuum fluorescent display device of the first preferred embodiment shown in FIG. 1A on which an anchor 11' having the structure of the conventional cathode support 11 shown in FIG. 5 is overlapped. In case of employing the cathode support 11' of the conventional type in which the anchor and the support are separate members (FIG. 1B illustrates only the anchor 11'), the envelop 1 is interfered with an end portion of the anchor 11' (i.e., the conventional cathode support). In this preferred embodiment, a dead space D inside the envelop 1 can be reduced, thereby enlarging the display area A. Alternatively, the envelop 1 may be made smaller without sacrificing the number of the cathodes 10 and the display area A.

Further, in accordance with this preferred embodiment of the present invention, the anchor 22' and the support member 23 are divided by the slit 24, and the base 21 connecting the anchor 22' and the support member 23 is fixed on the anode substrate 2. Therefore, vibrations of the neighboring anchors 22' of the support member 23 are hardly transmitted thereto, so that vibration or disconnection of the cathode 10 fixed on the support member 23 can be prevented.

Figure 4:
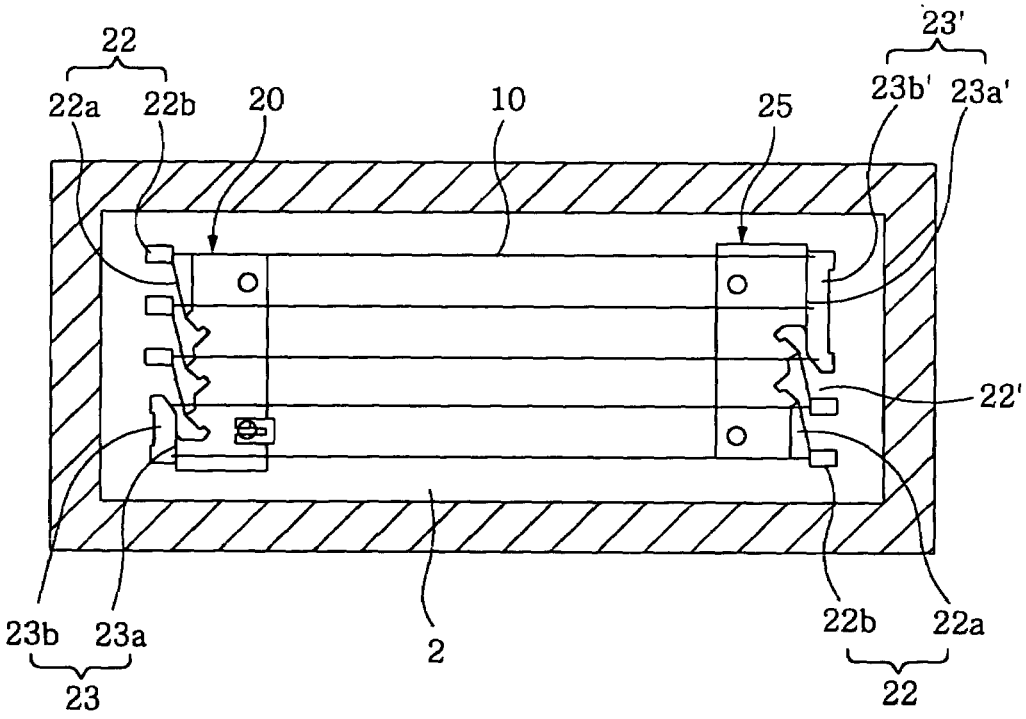
FIG. 4 presents a cross-sectional plan view of a vacuum fluorescent display device in accordance with a second preferred embodiment of the present invention.

As described above with reference to FIG. 1A, one of the cathodes 10 is supported by two anchors 22', so that the odd number of cathodes 10 can be supported by a pair of cathode supports 20 with the same structure. However, as shown in FIG. 4, a pair of cathode supports 20 and 25 with different structures may be employed. Specifically, the cathode support 20 has the structure shown in FIG. 3. The cathode support 25 has a structure basically identical to that of the cathode support 20 but with two anchors 22 and 22' and one support member 23' by which three cathodes 10 are supported.

In the vacuum fluorescent display device in accordance with the present invention, one or more anchors and at least one support member are seamlessly formed in one piece while separating the support member from its adjacent anchor by the slit, so that the distance between cathodes can be reduced by shortening the length of the arm of each of the anchors. Thus, the distance between the cathodes and the anodes can be decreased and, therefore, power saving by way of applying a low voltage to the cathode and/or brightness improvement can be achieved.

In addition, since the support and its adjacent anchor are separated from each other by the slit and the base, which connects the anchor and the support, is fixed on the anode substrate, vibrations of the anchor are hardly transmitted to the support member, thereby preventing vibration or disconnection of the cathodes fixed on the support member.

While the invention has been shown and described with respect to the preferred embodiments, it will be understood by those skilled in the art that various changes and modifications may be made without departing from the spirit and scope of the invention as defined in the following claims.

What is claimed is:

1. A fluorescent display device comprising:

an envelope of which an inner space is in a vacuum state, the envelope having therein a plurality of filament-shaped cathodes supported by a pair of cathode supports; and anodes, each having a fluorescent material, fluorescent materials of the anodes radiating light by impaction of electrons emitted from the cathodes;

wherein each of the cathode supports includes a base fixed to the envelope; one or more anchors, each having an arm serving as a resilient member for applying tension to a cathode connected thereto and a tab connected to one end of the cathode, the arm having a distal end portion and a proximal end portion, the proximal end portion being connected to the base and the tab being disposed at the distal end portion; and a support member separated from the arm of its adjacent anchor and having a base portion and a tab portion, the base portion being connected to the base and bent upright and the tab portion being extended from the base portion and supporting one end of another cathode, wherein the support member and the anchors are connected via the base, and wherein the arm of each anchors is slanted with respect to a lengthwise direction of the cathode, and the base portion of the support member is disposed normal to the lengthwise direction of the cathode.

2. The fluorescent display device of claim 1, wherein each of the cathode supports is formed by bending a shaped sheet, and the shaped sheet has a slit formed between the support member and its adjacent anchor, the support member and its adjacent anchor being seamlessly connected to the base.

3. The fluorescent display device of claim 1, wherein the other end of said another cathode is connected to an anchor of the other cathode support.

4. The fluorescent display device of claim 1, wherein the cathode supports are point-symmetrically disposed in the envelope.

5. The fluorescent display device of claim 1, wherein the arms are spaced apart from each other at regular intervals and are disposed in parallel at one side of the base.

6. The fluorescent display device of claim 1, wherein said another cathode is disposed above the arm of the adjacent anchor.

7. A cathode support for use in a fluorescent display device including an envelope of which an inner space is in a vacuum state, the envelope having therein filament-shaped cathodes; and anodes, each anode having a fluorescent material, fluorescent materials of the anodes radiating light by impaction of electrons emitted from the cathodes, the cathode support supporting the cathodes inside the envelope and comprising:

a base fixed to the envelope;

one or more anchors, each having an arm serving as a resilient member for applying tension to a cathode connected thereto and a tab connected to one end of the cathode, the arm having a distal end portion and a proximal end portion, the proximal end portion being connected to the base and the tab being disposed at the distal end portion; and a support member separated from the arm of its adjacent anchor and having a base portion and a tab portion, the base portion being connected to the base and bent upright and the tab portion being extended from the base portion and supporting one end of another cathode, wherein the support member and the anchors are connected via the base, and wherein the arm of each anchors is slanted with respect to a lengthwise direction of the cathode, and the base portion of the support member is disposed normal to the lengthwise direction of the cathode.

8. The cathode support of claim 7, wherein the arms are spaced apart from each other at regular intervals and are disposed in parallel at one side of the base.

9. The cathode support of claim 7, wherein said another cathode is disposed above the arm of the adjacent anchor.

* * * * *